US008367596B2

(12) United States Patent
Fossum et al.

(10) Patent No.: US 8,367,596 B2
(45) **Date of Patent: *Feb. 5, 2013**

(54) LAUNDRY DETERGENT COMPOSITIONS IN THE FORM OF AN ARTICLE

(75) Inventors: Renae Dianna Fossum, Middletown, OH (US); Robert Wayne Glenn, Jr., Liberty Township, OH (US); Heather Anne Doria, Hamilton, OH (US); Mark Robert Sivik, Mason, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 158 days.

This patent is subject to a terminal disclaimer.

(21) Appl. No.: 12/847,110

(22) Filed: Jul. 30, 2010

(65) Prior Publication Data

US 2011/0028374 A1 Feb. 3, 2011

Related U.S. Application Data

(60) Provisional application No. 61/230,000, filed on Jul. 30, 2009.

(51) Int. Cl.

| | |
|---|---|
| ***C11D 17/00*** | (2006.01) |
| ***C11D 3/37*** | (2006.01) |
| ***C11D 3/386*** | (2006.01) |
| ***C11D 3/395*** | (2006.01) |
| ***C11D 3/42*** | (2006.01) |

(52) U.S. Cl. ..... 510/276; 510/302; 510/320; 510/324; 510/445; 510/455

(58) Field of Classification Search ..... 510/276, 510/302, 320, 443, 445, 452, 455, 457, 324
See application file for complete search history.

(56) References Cited

U.S. PATENT DOCUMENTS

| | | | | |
|---|---|---|---|---|
| 3,299,112 | A | 1/1967 | Bailey | |
| 3,549,541 | A * | 12/1970 | Reinish | 510/392 |
| 3,594,328 | A | 7/1971 | Schibler | |
| 3,929,678 | A | 12/1975 | Laughlin et al. | |
| 4,234,627 | A | 11/1980 | Schilling | |
| 4,424,134 | A | 1/1984 | Sissin et al. | |
| 4,514,461 | A | 4/1985 | Woo | |
| 4,539,135 | A | 9/1985 | Ramachandran | |
| RE32,713 | E | 7/1988 | Woo | |
| 4,767,547 | A | 8/1988 | Straathof et al. | |
| 4,818,421 | A | 4/1989 | Boris et al. | |
| 4,882,220 | A | 11/1989 | Ono et al. | |
| 4,911,852 | A | 3/1990 | Coffindaffer et al. | |
| 4,917,920 | A | 4/1990 | Ono et al. | |
| 5,082,578 | A | 1/1992 | Langer et al. | |
| 5,457,895 | A | 10/1995 | Thompson | |
| 5,463,416 | A | 10/1995 | Paton | |
| 5,545,340 | A | 8/1996 | Wahl | |
| 5,545,350 | A | 8/1996 | Baker | |
| 5,562,849 | A | 10/1996 | Wahl | |
| 5,574,179 | A | 11/1996 | Wahl | |
| 5,651,976 | A | 7/1997 | Price | |
| 5,807,956 | A | 9/1998 | Czech | |
| 5,858,959 | A | 1/1999 | Surutzidis | |
| 5,981,681 | A | 11/1999 | Czech | |
| 6,048,830 | A | 4/2000 | Gallon | |
| 6,106,849 | A | 8/2000 | Malkan | |
| 6,200,949 | B1 | 3/2001 | Reijmer | |
| 6,245,732 | B1 | 6/2001 | Gallon | |
| 6,376,453 | B1 * | 4/2002 | Kubota et al. | 510/438 |
| 6,458,754 | B1 | 10/2002 | Velazquez | |
| 6,551,986 | B1 | 4/2003 | Littig | |
| 6,642,200 | B1 | 11/2003 | Zhang | |
| 6,645,479 | B1 | 11/2003 | Shefer | |
| 6,740,631 | B2 | 5/2004 | Shefer | |
| 6,787,512 | B1 | 9/2004 | Verrall | |
| 6,815,069 | B2 | 11/2004 | Hohberg | |
| 6,903,061 | B2 | 6/2005 | Masschelein | |
| 7,053,034 | B2 | 5/2006 | Shefer | |
| 7,125,835 | B2 | 10/2006 | Bennett | |
| 7,135,451 | B2 | 11/2006 | Corona, III | |
| 7,153,924 | B2 | 12/2006 | Kuepfer | |
| 7,196,049 | B2 | 3/2007 | Brain | |
| 7,238,655 | B2 | 7/2007 | Ness | |
| 7,256,168 | B2 * | 8/2007 | Raehse et al. | 510/446 |
| 7,273,837 | B2 | 9/2007 | Boutique | |
| 7,321,019 | B2 | 1/2008 | Ziche | |
| 7,335,630 | B2 | 2/2008 | Delplancke | |
| 7,365,043 | B2 | 4/2008 | Baker | |
| 7,381,697 | B2 | 6/2008 | Lentsch | |
| 7,427,648 | B2 | 9/2008 | Ochs | |
| 7,585,824 | B2 | 9/2009 | Popplewell et al. | |
| 7,723,284 | B2 | 5/2010 | Mane | |
| 7,799,752 | B2 | 9/2010 | Ness | |

(Continued)

FOREIGN PATENT DOCUMENTS

| | | | |
|---|---|---|---|
| EP | 0283165 | B1 | 10/1992 |
| EP | 1141207 | | 11/1999 |
| WO | WO 00/56849 | | 9/2000 |
| WO | WO 03/091028 | A1 | 11/2003 |
| WO | WO 2005/002360 | | 1/2005 |
| WO | WO 2009095891 | | 8/2009 |
| WO | WO 2010043692 | A1 | 4/2010 |

OTHER PUBLICATIONS

U.S. Appl. No. 12/831,618, filed Jul. 9, 2010, Fossum, et al.
U.S. Appl. No. 12/847,093, filed Jul. 30, 2010, Fossum, et al.
U.S. Appl. No. 61/024,728, filed Jan. 30, 2008, Glenn, Jr., Robert Wayne.
U.S. Appl. No. 61/045,444, filed Apr. 16, 2008, Glenn, Jr., Robert Wayne.
U.S. Appl. No. 12/361,634, filed Sep. 17, 2008, Glenn, Jr., Robert W.
U.S. Appl. No. 12/080,358, filed Oct. 2, 2008, Wahl, Errol Hoffman.
U.S. Appl. No. 61/120,637, filed Dec. 8, 2008, Glenn, Jr., Robert Wayne.
U.S. Appl. No. 61/120,643, filed Dec. 8, 2008, Glenn, Jr., Robert Wayne.

(Continued)

*Primary Examiner* — Lorna M Douyon
(74) *Attorney, Agent, or Firm* — Melissa G. Krasovec; Steven W. Miller

(57) ABSTRACT

A laundry additive article comprises surfactant, water-soluble and/or water-dispersible film-forming polymer, plasticizer, bleach, suds suppressor and Remaining Water. The article is in the form of a first flexible porous dissolvable solid structure having a dry density and having a Percent open cell content.

2 Claims, No Drawings

U.S. PATENT DOCUMENTS

| | | | | |
|---|---|---|---|---|
| 2003/0125222 | A1 | 7/2003 | Jahns | |
| 2003/0158344 | A1 | 8/2003 | Rodriques | |
| 2003/0165692 | A1 | 9/2003 | Koch | |
| 2003/0215417 | A1 | 11/2003 | Uchiyama | |
| 2003/0216488 | A1 | 11/2003 | Uchiyama | |
| 2004/0071742 | A1 | 4/2004 | Popplewell | |
| 2005/0098759 | A1 | 5/2005 | Frankenbach | |
| 2005/0170994 | A1 | 8/2005 | Casado-Dominguez | |
| 2005/0192207 | A1 | 9/2005 | Morgan, III | |
| 2006/0252668 | A1 | 11/2006 | Frankenbach | |
| 2007/0225388 | A1 | 9/2007 | Cooper | |
| 2007/0275866 | A1 | 11/2007 | Dykstra | |
| 2009/0035337 | A1* | 2/2009 | Artiga-Gonzalez et al. | 424/401 |
| 2009/0263342 | A1 | 10/2009 | Glenn, Jr. | |
| 2010/0298188 | A1* | 11/2010 | Glenn et al. | 510/120 |

OTHER PUBLICATIONS

U.S. Appl. No. 61/120,765, filed Dec. 8, 2008, Glenn, Jr., Robert Wayne.

U.S. Appl. No. 61/120,786, filed Dec. 8, 2008, Glenn, Jr., Robert Wayne.

U.S. Appl. No. 61/120,790, filed Dec. 8, 2008, Glenn, Jr., Robert Wayne.

U.S. Appl. No. 61/170,150, filed Apr. 17, 2009, Panandiker, Rajan Keshav.

U.S. Appl. No. 61/221,632, filed Jun. 30, 2009, Panadiker, Rajan Keshav.

U.S. Appl. No. 61/229,981, filed Jul. 30, 2009, Fossum, Renae Dianna.

U.S. Appl. No. 61/319,939, filed Apr. 1, 2010, Cox, Jeremy Wayne.

* cited by examiner

LAUNDRY DETERGENT COMPOSITIONS IN THE FORM OF AN ARTICLE

CROSS REFERENCE TO RELATED APPLICATIONS

This application claims priority under 35 U.S.C. §119(e) to U.S. Provisional Application Ser. No. 61/230,000, filed Jul. 30, 2009.

FIELD OF THE INVENTION

The present invention relates to laundry detergent compositions in the form of an article that is a flexible, porous dissolvable solid.

BACKGROUND OF THE INVENTION

Laundry detergent products are sold and packaged in various forms. For example, liquid laundry detergent or laundry and bleach additives may be provided in bulk such that one package contains multiple doses. Consumers will open the package and meter doses into the washing machine and/or laundry liquor as needed.

Although widely used, bulk liquid product forms may have associated issues in terms of packaging, storage, transportation and/or convenience of use. For example, liquid detergent products are typically sold in bottles which may add significant cost to the finished product. Additionally, liquid detergent products may comprise a substantial amount of water in the formula. The water content can increase the bulk of the product, which may in turn adversely impact the associated shipping and storage costs. Additionally, liquid laundry products can be messy. This messiness may cause inconvenience to the consumer when attempting to meter out an accurate dose as it may result in drips and residue on the outside of the bottle as well as in the dispenser of the washing machine.

Liquid detergent and laundry and bleach additive formulations may also be characterized by physical stability challenges including, but not limited to, phase separation, gelling and creaming, any of which may lead to a shorter shelf life.

Some laundry detergent products are sold in unit dose form. Often, the unit dose comprises a liquid and/or solid detergent packaged within a water soluble single or multi-compartment pouch. The pouches may be made of water soluble films which tendency to burst upon storage, particularly if moisture is transferred onto the pouch, via, for example damp hands reaching into the pack of pouches. Multicompartment pouches are known, and are sometimes used to separate physically or chemically, incompatible actives such as bleaches, enzymes and the like, or additional benefit agents; however this may lead to a costly process. and/or require use of costly stabilizing aids A further issue relates to use of certain solvents such as ethanol or propane dial as adjuncts to permit the formulation of certain active, are volatile and do not really add to the overall performance efficacy of the laundry detergent system. Many laundry products are marketed today as multi benefit products (e.g. cleaning with shine, anti corrosion etc type benefits and often require sophisticated encapsulation technologies to permit a 'delayed' or 'triggered release' profile, for example during the rinsing stage. Tablets are also known; however an issue with such tablets is that they may have a tendency to crumble (e.g. upon transportation) owing to their brittleness.

The aforementioned issues may be addressed by providing a liquid formulation in the alternative form of a porous dissolvable solid structure containing little or no water. For example, such an article could be packaged as a single unit or in multiple units and shipped at a lower cost as compared to the traditional liquid form equivalent. Such an article could eliminate the difficulty and mess associated with handling a liquid dishwashing formulation since no metered pouring would be required. Moreover, many of the stability issues of the liquid form would be eliminated via physical separation such that actives could be combined in new ways that were heretofore impractical and/or impossible.

For porous dissolvable solid structures to be a practical form in which to supply a liquid detergent cleaning composition to the consumer, several further challenges must be addressed. For example, it may be required that a relatively high activity of around 20 g of actives such as performance ingredients be incorporated into the foams at a high enough density such that the amount of performance active that is delivered is sufficient to deliver comparable cleaning under the same conditions. In this way, the use of a porous dissolvable solid structure provides several advantages over the like use of a film.

Based upon the foregoing, a need exists for a flexible, bendable, soft to the touch, dissolvable porous solid structure which can be easily and quickly formulated and manufactured and that provides the properties of flexibility, dissolution and fabric conditioning desired by consumers. Such a structure should be provided to the consumer in a size that is easy to dose such as in the drawer of a front-loading washing machine, or easy to dose in a sachet for a hand-rinsing application.

Some of the advantages of the development include the following:

a) Convenient, lightweight, 'portable', dose controllable product
a) Permits high loading of fragrance and dry substrate form enables perfume diffusion into 'headspace' (impression e.g. in store/laundry room, etc).
b) Enables formulations with lower solvent and stabilizer content.
c) Enables formulations of metal catalysts (or other bleaches), hueing dyes, enzymes such as lipases.
d) Reduces potential for messiness.
e) Makes compacted formulas appear larger making dose size more believable.
f) Removes the need for 'clear' formulas
g) Removes the need for rheology structuring agents
h) Will aid dissolution of compacted products that may otherwise not dispense properly It is therefore an object of the present invention to provide a dissolvable solid fabric and home care product that can be conveniently and quickly dissolved to reconstitute a liquid product for ease of use and application (with similar performance as today's liquid fabric and home care products). It is a further object of the present invention to provide such a product that can be produced in an economical manner by physical aeration followed by subsequent drying. It is an even further object of the present invention to provide such a product with desirable flexibility.

SUMMARY OF THE INVENTION

The present invention relates to fabric and home care articles comprising: from about 10% to about 75% surfactant; from about 0% to about 90% water soluble polymer; and optionally, from about 1% to about 15% plasticizer; such that the article is in the form of a flexible porous dissolvable solid structure, wherein said article has a % open cell content of from about 80% to about 100%. In some embodiments, the article may be a laundry and bleach additive comprising any one or more of the following: surfactant, film-forming water-soluble polymer; plasticizer; chelant; bleach; bleach stabilizer; suds suppressor; and Remaining Water. The article is in the form of a first flexible porous dissolvable solid structure having a dry density and having a Percent open cell content of from about 5% to about 99.9%.

In yet another aspect, the present invention relates to a process comprising the steps of: Preparing a pre-mix comprising surfactant, plasticizer, and optionally water soluble polymer, wherein said pre-mix has: from about 10% to 85% solids; and, upon the addition of the water soluble polymer, the resulting premix has a viscosity of from about 2,500 cps to 30,000 cps; aerating said pre-mix by introducing a gas into the pre-mix to form a wet aerated pre-mix; forming the wet aerated pre-mix into a desired one or more shapes to form shaped wet pre-mix; and drying the shaped wet pre-mix to a desired final moisture content to form a porous dissolvable solid structure.

In particular embodiments, the fabric and home care article has a cellular interconnectivity defined by a porous solid with a Star Volume of from about 1 $mm^3$ to about 90 $mm^3$; and a Structure Model Index that is non-negative and ranges from about 0.0 to about 3.0.

In some embodiments, the article has a Cell Wall Thickness of from about from about 0.02 mm to about 0.015 mm; and a Specific Surface Area of from about 0.03 $m^2/g$ to about 0.25 $m^2/g$.

DETAILED DESCRIPTION OF THE INVENTION

The present inventors have found that dissolvable solid fabric or home care products can be prepared that can be conveniently and quickly dissolved in water by the consumer to reconstitute a liquid product for ease of washing clothes by hand or by machine, cleaning floors, surfaces, etc., as indicated by the porous dissolvable solid product while providing sufficient delivery of active agents for fabric, dish or home care applications (with similar performance as conventional liquid products). It has also been found that such products can be produced in an economical manner by physical aeration followed by subsequent drying. Additionally, it has been found that such products can now be produced with desirable softness and flexibility.

The present inventors have surprisingly discovered that rapidly-dissolving porous solids with a predominantly open-celled structure can be produced via physical aeration followed by subsequent drying (as a more cost effective alternative to conventional freeze drying). This can be accomplished by creating a physically aerated wet foam with a controlled degree of foam instability during the drying process such that an optimum level of bubble breakage and coalescence occurs to generate a plurality of open channels and without collapse of the foam plateau border three dimensional structure during the drying process thereby maintaining the physical strength and cohesiveness of the porous solid.

It was surprising and non-intuitive to discover that this instability and coalescence could be controllably manipulated such that original closed-cell wet foam transforms within the multi-hour drying process into a true open-celled porous structure wherein the plurality of open-channels extend to the solid's surface. Indeed, the vast majority of original attempts by the present inventors led to either stable wet foams drying to conventional closed-cell solid foams or unstable wet foams drying to collapsed films. It has been further discovered that such open-celled dissolvable porous solids prepared by physical aeration followed by drying can only be prepared within specific rheological and compositional ranges (% solids). Moreover, it has been discovered that such open-celled dissolvable porous solids can be prepared with significant plasticizer levels for desirable softness and flexibility.

The flexible porous dissolvable solid structure article may be referred to herein as "the Article" or "the Dissolvable Article". All references are intended to mean the flexible dissolvable porous solid structure article.

Elongation Test and Tensile-Stress Test

This test method is used to measure the elongation at break (=extensibility at break) and tensile properties of porous substrates as used herein, by applying a uniaxial strain to a sample and measuring the force that is required to elongate the sample. A preferred piece of equipment to do the tests is a tensile tester such as an MTS Synergie100 or an MTS Alliance available from MTS Systems Corporation 14000 Technology Drive, Eden Prairie, Minn., USA, with a 25N or 50N load cell. This measures the Constant Rate of Extension in which the pulling grip moves at a uniform rate and the force measuring mechanisms moves a negligible distance (less than 0.13 mm) with increasing force. The load cell is selected such that the measured loads (e.g. force) of the tested samples will be between 10 and 90% of the capacity of the load cell.

As used herein, "dissolvable" means that the flexible porous dissolvable solid structure article meets the beaker dissolution value. The Article has a beaker dissolution value of from about 1 second to about 600 seconds (10 minutes), in one embodiment about 50 seconds, in another embodiment about 20 seconds, in another embodiment about 37 seconds, in another embodiment about 15 seconds, in another embodiment about 17 seconds, and in still another embodiment about 25 seconds as measured by the Beaker Dissolution Method.

As used herein "porous solid structure" means a solid, interconnected, polymer-containing matrix that defines a network of spaces or cells that contain the gas of the surrounding atmosphere, typically air. The interconnectivity of the structure may be described by a Star Volume or a Percent Open Cell Content.

The Article has a Star Volume of from about 1.5 $mm^3$ to about 90 $mm^3$, in one embodiment about 4-15 $mm^3$, in another embodiment about 5 $mm^3$, and in still another embodiment about 5-10 $mm^3$. The Article has a Percent Open Cell Content of from about 20% to 99%, in one embodiment about 90%, in another embodiment about, 96%, in another embodiment about 93%, in another embodiment about 99%, and in another embodiment about 99%.

To measure the cell interconnectivity via the Star Volume and the Structure Model Index, disk-like samples, approximately 4 cm in diameter and 3 to 7 mm high, are scanned using a micro computed tomography system (μCT80, SN 06071200, Scanco Medical AG). Each sample is imaged while sitting flat on the bottom of a cylindrical tube. Image acquisition parameters are 45 kVp, 177 μA, 51.2 mm field of view, 800 ms integration time, 1000 projections. The number of slices is adjusted to cover the height of the sample. The reconstructed data set consisted of a stack of images, each 2048×2048 pixels, with an isotropic resolution of 25 μm. For data analysis, a volume of interest is selected to be fully within the sample, avoiding the surface region. A typical volume of interest is 1028×772×98 voxels.

Structure Model Index (SMI) is measured using Scanco Medical's Bone Trabecular Morphometry evaluation with a threshold of 17. With this index the structural appearance of trabecular bone is quantified (see T. Hildebrand, P. Rüegsegger. Quantification of bone microarchitecture with the structure model index. *Comp Meth Biomech Biomed Eng* 1997; 1:15-23). The triangulated surface is dilated in normal direction by an infinitesimal amount, and the new bone surface and volume is calculated. By this, the derivative of the bone surface (dBS/dr) can be determined. The SMI is then represented by the equation:

$$SMI = 6 \cdot \frac{BV \cdot \frac{dBS}{dr}}{BS^2}$$

SMI relates to the convexity of the structure to a model type. Ideal (flat) plates have an SMI of 0 (no surface change with dilation of the plates), whereas ideal cylindrical rods have an SMI of 3 (linear increase in surface with dilation of rods). Round spheres have an SMI of 4. Concave structure gives negative dBS/dr, resulting in negative SMI values. Artificial boundaries at the edge of the volume of interest are not included in the calculation and thus suppressed.

In addition to the Scanco Medical Analysis, Star Volume measurements are made. Star Volume is a measure of the "openness" of the void space in a two phase structure. By choosing a random uniformly distributed set of points in the phase of interest (in this case the phase of interest is the void space or air), lines can be extended in random directions from each of these points. The lines are extended until they touch the foreground phase. The length of each of these lines is then recorded. The random points have a sampling of 10 in each direction (x/y/z) and at each point 10 random angles are chosen. If the line extends to the border of the ROI of interest that line is discarded (only accept lines that actually intersect with the foreground phase). The final equation is based upon the research entitled *Star Volume In Bone Research A Histomorphometric Analysis Of Trabecular Bone Structure Using Vertical Sections*; Vesterby, A.; Anat Rec.; 1993 February; 235(2):325-334.

$$StarVolume = \frac{4}{3}\pi \cdot \frac{\sum dist^3}{N}$$

wherein "dist" is the individual distances and N is the number of lines examined.

The Percent Open Cell Content is measured via gas pycnometry. Gas pycnometry is a common analytical technique that uses a gas displacement method to measure volume accurately. Inert gases, such as helium or nitrogen, are used as the displacement medium. The sample is sealed in the instrument compartment of known volume, the appropriate inert gas is admitted, and then expanded into another precision internal volume. The pressure before and after expansion is measured and used to compute the sample volume. Dividing this volume into the sample weight gives the gas displacement density. ASTM Standard Test Method D2856 provides a procedure for determining the percentage of open cells using an older model of an air comparison pycnometer. This device is no longer manufactured. However, you can determine the percentage of open cells conveniently and with precision by performing a test which uses Micromeritics' AccuPyc Pycnometer. The ASTM procedure D2856 describes 5 methods (A, B, C, D, and E) for determining the percent of open cells of foam materials. The samples can be analyzed using an Accupyc 1340 using nitrogen gas with the ASTM foampyc software. Method C of the ASTM procedure is to be used to calculate to percent open cells. This method simply compares the geometric volume as determined using calipers and standard volume calculations to the true volume as measured by the Accupyc. It is recommended that these measurements be conducted by Micromeretics Analytical Services, Inc. (One Micromeritics Dr, Suite 200, Norcross, Ga. 30093). More information on this technique is available on the Micromeretics Analytical Services web sites (www.particletesting.com or www.micromeritics.com), or published in a book, "Analytical Methods in Fine particle Technology", by Clyde On and Paul Webb.

The Article may have a maximum Cell Wall Thickness. For example, in some embodiments, the Article has a Cell Wall Thickness of from about from about 0.02 mm to about 1 mm, in one embodiment from about 0.02 mm to about 0.5 mm, in another embodiment from about 0.03 mm to about 0.1 mm, and in still another embodiment from about 0.035 mm to about 0.06 mm.

The Cell Wall Thickness is computed from the scanned images via a micro computed tomography system (μCT80, SN 06071200, Scanco Medical AG) as described herein. The Cell Wall Thickness is determined according to the method defined for the measurement of Trabecular Thickness using Scanco Medical's Bone Trabecular Morphometry evaluation. The definition of Trabecular Thickness as taken from the Scanco User's manual: Trabecular Thickness uses a Euclidean distance transformation (EDM), which calculates the Euclidean distance from any point in the foreground to the nearest background point. The Trabecular Thickness measure represents twice the centerline values associated with the local maxima of the EDM, which represents the distance to the center of the object (twice this distance will yield the thickness).

The Article has a minimum Specific Surface Area. The Article has a Specific Surface Area of from about 0.02 $m^2/g$ to about 0.25 $m^2/g$, in one embodiment from about 0.03 $m^2/g$ to about 0.22 $m^2/g$, in another embodiment from about 0.04 $m^2/g$ to about 0.19 $m^2/g$, and in still another embodiment from about 0.035 $m^2/g$ to about 0.16 $m^2/g$.

The Specific Surface Area is measured via a gas adsorption technique. Surface Area is a measure of the exposed surface of a solid sample on the molecular scale. The BET (Brunauer, Emmet, and Teller) theory is the most popular model used to determine the surface area and is based upon gas adsorption isotherms. Gas Adsorption uses physical adsorption and capillary condensation to measure a gas adsorption isotherm. The technique is summarized by the following steps; a sample is placed in a sample tube and is heated under vacuum or flowing gas to remove contamination on the surface of the sample. The sample weight is obtained by subtracting the empty sample tube weight from the combined weight of the degassed sample and the sample tube. The sample tube is then placed on the analysis port and the analysis is started. The first step in the analysis process is to evacuate the sample tube, followed by a measurement of the free space volume in the sample tube using helium gas at liquid nitrogen temperatures. The sample is then evacuated a second time to remove the helium gas. The instrument then begins collecting the adsorption isotherm by dosing krypton gas at user specified intervals until the requested pressure measurements are achieved. Samples may then analyzed using an ASAP 2420 with krypton gas adsorption.

It is recommended that the gas adsorption and pycnometry measurements be conducted by Micromeretics Analytical Services, Inc. (One Micromeritics Dr, Suite 200, Norcross, Ga. 30093). More information on this technique is available on the Micromeretics Analytical Services web sites (www- .particletesting.com or www.micromeritics.com), or published in a book, "Analytical Methods in Fine particle Technology", by Clyde On and Paul Webb.

In some embodiments, the Article may be a flat, flexible substrate in the form of a pad, a strip or tape and having a thickness of from about 1.0 mm to about 30 mm, in one embodiment from about 2 mm to about 15 mm, in another embodiment from about 3 mm to about 8 mm, and in a further embodiment from about 4 mm to about 7 mm as measured by the below methodology. In some embodiments, the article may be irregular in shape or have a unique form such as a star, crescent moon, character and/or any design to connote the function of the Article.

The thickness of the dissolvable porous solid (i.e., substrate or sample substrate) is obtained using a micrometer or thickness gage, such as the Mitutoyo Corporation Digital Disk Stand Micrometer Model Number IDS-1012E (Mitutoyo Corporation, 965 Corporate Blvd, Aurora, Ill., USA 60504). The micrometer has a 1 inch diameter platen weighing about 32 grams, which measures thickness at an application pressure of about 40.7 psi (6.32 gm/cm$^2$). In the case of cylindrical, spherical, or other objects with more of a third dimension versus a pad or strip, the thickness is taken as the maximum distance of the shortest dimension, i.e., the diameter of a sphere or cylinder for instance, and the thickness ranges are the same as described above. The thickness of the dissolvable porous solid is measured by raising the platen, placing a section of the sample substrate on the stand beneath the platen, carefully lowering the platen to contact the sample substrate, releasing the platen, and measuring the thickness of the sample substrate in millimeters on the digital readout. The sample substrate should be fully extended to all edges of the platen to make sure thickness is measured at the lowest possible surface pressure, except for the case of more rigid substrates which are not flat. For more rigid substrates which are not completely flat, a flat edge of the substrate is measured using only one portion of the platen impinging on the flat portion of the substrate.

The Article has a basis weight 125 grams/m$^2$ to about 2,000 grams/m$^2$, in another embodiment from about 150 grams/m$^2$ to about 1500 grams/m$^2$, in an alternate embodiment from about 200 grams/m$^2$ to about 1000 grams/m$^2$.

The Basis Weight of the dissolvable porous solid component of the fabric and home care composition herein is calculated as the weight of the dissolvable porous solid component per area of the selected dissolvable porous solid (grams/m$^2$). The area is calculated as the projected area onto a flat surface perpendicular to the outer edges of the porous solid. For a flat object, the area is thus computed based on the area enclosed within the outer perimeter of the sample. For a spherical object, the area is thus computed based on the average diameter as $3.14\times(\text{diameter}/2)^2$. For a cylindrical object, the area is thus computed based on the average diameter and average length as diameter×length. For an irregularly shaped three dimensional object, the area is computed based on the side with the largest outer dimensions projected onto a flat surface oriented perpendicularly to this side. This can be accomplished by carefully tracing the outer dimensions of the object onto a piece of graph paper with a pencil and then computing the area by approximate counting of the squares and multiplying by the known area of the squares or by taking a picture of the traced area (preferably shaded-in for contrast) including a scale and using image analysis techniques.

The Article has a dry density of from about 0.03 g/cm$^3$ to about 0.35 g/cm$^3$, in one embodiment from about 0.04 g/cm$^3$ to about 0.25 g/cm$^3$, and in an alternate embodiment from about 0.06 g/cm$^3$ to about 0.20 g/cm$^3$.

The dry density of the dissolvable porous solid is determined by the equation: Calculated Density=Basis Weight of porous solid/(Porous Solid Thickness×1,000). The Basis Weight and Thickness of the dissolvable porous solid are determined in accordance with the methodologies described herein.

It has been surprisingly discovered by the present inventors that rapidly dissolving porous solids with a predominantly inter-connected, open-celled structure can be produced via physical aeration followed by subsequent drying (as a more cost-effective alternative to conventional freeze drying). This can be accomplished by creating a physically aerated wet foam with a controlled degree of instability during the drying process such that an optimum level of bubble breakage and coalescence occurs to generate a plurality of open channels, and without collapse of the three dimensional foam plateau border structure during the drying process, thereby maintaining the physical strength and cohesiveness of the porous solid. It was surprising and non-intuitive to discover that this instability and coalescence could be controllably manipulated such that the original closed-cell wet foam transforms within the multi-hour drying process into a true open-celled porous structure wherein the plurality of open channels extends to the solid's surface and with sufficient structural integrity. Indeed, the vast majority of original attempts by the present inventors led to either wet foams that were too stable drying to conventional closed-cell porous solids or wet foams that were too unstable drying to collapsed films.

It has been discovered that such open-celled dissolvable porous solids prepared by physical aeration followed by drying can only be achieved within a narrowly defined rheological range as defined above. Achieving the relatively low viscosity range required is problematic due to the typically high polymeric structurant levels required for sufficient solid structure formation as well as at desired higher surfactant and % solids levels (for product compaction and sustainability). To achieve the required relatively low viscosity range of the present invention at relatively high surfactant and polymer levels while producing integral and cohesive solid structures, it has been discovered that several compositional strategies can be employed, either alone or in combination, including but not limited to: (i) employing water-soluble polymers within the requisite molecular weight range but with relatively low viscosity build as defined herein; (ii) deliberate dilution of the processing mixture with water; (iii) adding electrolyte or hydrotrope to manipulate the surfactant structure viscosity; or (iv) adding low molecular weight solvents to manipulate the viscosity. Importantly, aerating processing mixtures below the required viscosity range results in less desirable, low basis weight and non-cohesive porous solids.

It is also significant that the discovered processing mixture viscosity range of the present invention has been proven to produce rapidly dissolving open-celled porous solids independently of polymer type (including naturally derived) and surfactant system. This in itself is a surprising finding and goes against conventional wisdom that it is the polymer type, and specifically the molecular weight, that is the primary driver of solid dissolution (See US2003/0180242 by Eccard W. E. et. al.).

It has also been found that the above described characteristics of the present invention apply toward the production of open-celled porous structures employing either semi-continuous or continuous aeration equipment from the food industry that are used in the manufacture of marshmallows.

It has been surprisingly found that processing mixtures wherein the surfactant phase structure is in the form of lamellar liquid crystals (as opposed to isotropic thread-like micelles) produce porous solids with improved appearance and cohesiveness.

Unlike many solid-making processes such as extrusion, the above physical aeration and drying process of the present invention is not limited to solid-sourced surfactants which are typically more crystalline and have performance negatives (skin and scalp harshness and sensorial issues). Accordingly, at least about 10% of the surfactants, by weight of the substantially dry article, comprise surfactants with low crystallinity and having a Krafft temperature of less than about 40° C., and in another embodiment from about 0° C. to about 40° C., and in an alternate embodiment from about 0° C. to about 35° C. The Krafft point can be measured by preparing a 1% dispersion of the surfactant in water. If the surfactant is soluble at room temperature, the solution is cooled to 0° C. If the surfactant does not precipitate out, its Krafft point is considered to be less than 0° C. If it precipitates out, the solution is slowly warmed with stirring in a water bath. The temperature at which the precipitate dissolves is determined to be the Krafft point. If the Krafft point is above room temperature, the solution is first heated rapidly to dissolve all the surfactant. It is then cooled until precipitation occurs, and then slowly warmed to determine the Krafft point as described above. While not wishing to be bound by theory, it is believed that higher Krafft points are indicative of a surfactant being more crystalline and less soluble in an aqueous system. Krafft points for common surfactants can be referenced [Rosen M. J. (2004) "Surfactants and Interfacial Phenomena, 3rd Edition", John Wiley & Sons, New Jersey. ISBN 0-471-47818-0]

"Fabric or home care composition," as used herein, means a composition that may be applied to fabric, dishes, floors, glass, hard surfaces, etc., per the intended use without undue undesirable effects.

"Keratinous tissue," as used herein, means keratin-containing layers disposed as the outermost protective covering of mammals and includes, but is not limited to, skin, hair, scalp and nails.

"Fabric care benefit" or "home care benefit" as used herein includes, but is not limited to cleaning, reducing the oil, grease, dirt, stains, and/or shiny appearance of skin and/or hair, reducing dryness, itchiness and/or flakiness, reducing skin pore size, exfoliation, desquamation, improving the appearance of the keratinous tissue, conditioning, smoothening, etc.

"Beauty benefit agent," as used herein, refers to materials that can be included in the composition to deliver one or more Beauty benefits.

"Skin care actives," or "actives," as used herein, means compounds that, when applied to the skin, provide a benefit or improvement to the skin. It is to be understood that skin care actives are useful not only for application to skin, but also to hair, scalp, nails and other mammalian keratinous tissue.

The dissolvable fabric and home care porous solids of the present invention can be useful for treating keratinous tissue (e.g., hair, skin, or nails) condition. As use herein, "treating" or "treatment" or "treat" includes regulating and/or immediately improving keratinous tissue cosmetic appearance and/or feel. For instance, "regulating skin, hair, or nail condition" includes: thickening of skin, hair, or nails (e.g., building the epidermis and/or dermis and/or sub-dermal [e.g., subcutaneous fat or muscle] layers of the skin, and where applicable the keratinous layers of the nail and hair shaft) to reduce skin, hair, or nail atrophy, increasing the convolution of the dermal-epidermal border (also known as the rete ridges), preventing loss of skin or hair elasticity (loss, damage and/or inactivation of functional skin elastin) such as elastosis, sagging, loss of skin or hair recoil from deformation; melanin or non-melanin change in coloration to the skin, hair, or nails such as under eye circles, blotching (e.g., uneven red coloration due to, e.g., rosacea) (hereinafter referred to as "red blotchiness"), sallowness (pale color), discoloration caused by telangiectasia or spider vessels, and graying hair.

I. COMPOSITION

Surfactants

The Article comprises one or more surfactants suitable for application to the hair or skin. Surfactants suitable for use in the Article include anionic surfactants, nonionic surfactants, cationic surfactants, zwitterionic surfactants, amphoteric surfactants, or combinations thereof.

The one or more surfactants may be present from about 23 wt % to about 75 wt % by weight of the Article of surfactant, in one embodiment from about 30 wt % to about 70 wt %, and in another embodiment from about 40 wt % to about 65 wt % by weight of the Article of surfactant.

The surfactant component may also include surfactant that are intended primarily as a process aid in making a stable foam structure, wherein the surfactant includes conventional surfactants or emulsifiers that need not provide any lathering performance. Examples of emulsifiers for use as a surfactant component herein include mono- and di-glycerides, fatty alcohols, polyglycerol esters, propylene glycol esters, sorbitan esters and other emulsifiers known or otherwise commonly used to stabilize air interfaces.

Anionic surfactants suitable include those described in McCutcheon's Detergents and Emulsifiers, North American Edition (1986), Allured Publishing Corp.; McCutcheon's, Functional Materials, North American Edition (1992), Allured Publishing Corp.; and U.S. Pat. No. 3,929,678 (Laughlin et al.).

Non-limiting examples of anionic surfactants suitable for use herein include alkyl and alkyl ether sulfates, sulfated monoglycerides, sulfonated olefins, alkyl aryl sulfonates, primary or secondary alkane sulfonates, alkyl sulfosuccinates, acyl taurates, acyl isethionates, alkyl glycerylether sulfonate, sulfonated methyl esters, sulfonated fatty acids, alkyl phosphates, acyl glutamates, acyl sarcosinates, alkyl sulfoacetates, acylated peptides, alkyl ether carboxylates, acyl lactylates, anionic fluorosurfactants, sodium lauroyl glutamate, and combinations thereof.

Anionic surfactants suitable include alkyl and alkyl ether sulfates. These materials have the respective formulae $ROSO_3M$ and $RO(C_2H_4O)_xSO_3M$, wherein R is alkyl or alkenyl of from about 8 to about 24 carbon atoms, x is 1 to 10, and M is a water-soluble cation such as ammonium, sodium, potassium and triethanolamine. The alkyl ether sulfates are typically made as condensation products of ethylene oxide and monohydric alcohol's having from about 8 to about 24 carbon atoms. Preferably, R has from about 10 to about 18 carbon atoms in both the alkyl and alkyl ether sulfates. Useful alcohols can be derived from fats, e.g., coconut oil or tallow, or can be synthetic. Lauryl alcohol and straight chain alcohol's derived from coconut oil are preferred herein. Such alcohol's are reacted with about 1 to about 10, preferably from about 3 to about 5, and especially about 3, molar proportions of ethylene oxide and the resulting mixture of molecular species having, for example, an average of 3 moles of ethylene oxide per mole of alcohol, is sulfated and neutralized. Highly preferred alkyl ether sulfates are those comprising a mixture of individual compounds, said mixture having an average alkyl chain length of from about 10 to about 16 carbon atoms and an average degree of ethoxylation of from about 1 to about 4 moles of ethylene oxide.

Other suitable anionic surfactants include water-soluble salts of the organic, sulfuric acid reaction products of the general formula [$R^1$—$SO_3$-M], wherein $R^1$ is chosen from the group consisting of a straight or branched chain, saturated aliphatic hydrocarbon radical having from about 8 to about 24, preferably about 10 to about 18, carbon atoms; and M is a cation. Preferred are alkali metal and ammonium sulfonated $C_{10-18}$ n-paraffins.

Additional examples of suitable anionic surfactants are the reaction products of fatty acids esterified with isethionic acid and neutralized with sodium hydroxide where, for example, the fatty acids are derived from coconut oil; sodium or potassium salts of fatty acid amides of methyl tauride in which the fatty acids, for example, are derived from coconut oil. Other suitable anionic surfactants of this variety are described in U.S. Pat. No. 2,486,921, U.S. Pat. No. 2,486,922 and U.S. Pat. No. 2,396,278.

Still other suitable anionic surfactants are the succinamates, examples of which include disodium N-octadecylsulfosuccinamate; diammoniumlauryl sulfosuccinamate; tetrasodium N-(1,2-dicarboxyethyl)-N-octadecylsulfosuccinamate; diamyl ester of sodium sulfosuccinic acid; dihexyl ester of sodium sulfosuccinic acid; and dioctyl esters of sodium sulfosuccinic acid.

Other suitable anionic surfactants include olefin sulfonates having about 12 to about 24 carbon atoms. The α-olefins from which the olefin sulfonates are derived are mono-olefins having about 12 to about 24 carbon atoms, preferably about 14 to about 16 carbon atoms. Preferably, they are straight chain olefins.

Another class of anionic surfactants suitable for use in the fabric and home care compositions is the β-alkyloxy alkane sulfonates. These compounds have the following formula:

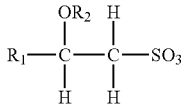

where $R_1$ is a straight chain alkyl group having from about 6 to about 20 carbon atoms, $R_2$ is a lower alkyl group having from about 1 (preferred) to about 3 carbon atoms, and M is a water-soluble cation as hereinbefore described.

Other suitable surfactants are described in *McCutcheon's, Emulsifiers and Detergents,* 1989 *Annual*, published by M. C. Publishing Co., and in U.S. Pat. No. 3,929,678.

Preferred anionic surfactants include ammonium lauryl sulfate, ammonium laureth sulfate, triethylamine lauryl sulfate, triethylamine laureth sulfate, triethanolamine lauryl sulfate, triethanolamine laureth sulfate, monoethanolamine lauryl sulfate, monoethanolamine laureth sulfate, diethanolamine lauryl sulfate, diethanolamine laureth sulfate, lauric monoglyceride sodium sulfate, sodium lauryl sulfate, sodium laureth sulfate, potassium lauryl sulfate, potassium laureth sulfate, sodium lauryl sarcosinate, sodium lauroyl sarcosinate, lauryl sarcosine, cocoyl sarcosine, ammonium cocoyl sulfate, ammonium lauroyl sulfate, sodium cocoyl sulfate, sodium lauroyl sulfate, potassium cocoyl sulfate, potassium lauryl sulfate, triethanolamine lauryl sulfate, triethanolamine lauryl sulfate, monoethanolamine cocoyl sulfate, monoethanolamine lauryl sulfate, sodium tridecyl benzene sulfonate, sodium dodecyl benzene sulfonate, and combinations thereof.

Amphoteric surfactants suitable for use in the fabric and home care compositions of the present invention includes those that are broadly described as derivatives of aliphatic secondary and tertiary amines in which the aliphatic radical can be straight or branched chain and wherein one of the aliphatic substituents contains from about 8 to about 18 carbon atoms and one contains an anionic water solubilizing group, e.g., carboxy, sulfonate, sulfate, phosphate, or phosphonate. Examples of compounds falling within this definition are sodium 3-dodecyl-aminopropionate, sodium 3-dodecylaminopropane sulfonate, sodium lauryl sarcosinate, N-alkyltaurines such as the one prepared by reacting dodecylamine with sodium isethionate according to the teaching of U.S. Pat. No. 2,658,072, N-higher alkyl aspartic acids such as those produced according to the teaching of U.S. Pat. No. 2,438,091, and the products described in U.S. Pat. No. 2,528,378. Zwitterionic surfactants suitable for use include those that are broadly described as derivatives of aliphatic quaternary ammonium, phosphonium, and sulfonium compounds, in which the aliphatic radicals can be straight or branched chain, and wherein one of the aliphatic substituents contains from about 8 to about 18 carbon atoms and one contains an anionic group, e.g., carboxy, sulfonate, sulfate, phosphate, or phosphonate. Zwitterionic surfactants which are suitable include betaines, including cocoamidopropyl betaine.

The amphoteric surfactants suitable herein may also include alkylamphoacetates including lauroamphoacetate and cocoamphoacetate. Alkylamphoacetates can be comprised of monoacetates and diacetates. In some types of alkylamphoacetates, diacetates are impurities or unintended reaction products.

Cationic surfactants can also be utilized, but are generally less preferred, and preferably represent less than about 5% by weight of the Article.

Suitable nonionic surfactants include those described in McCutcheion's Detergents and Emulsifiers, North American edition (1986), Allured Publishing Corp., and McCutcheion's Functional Materials, North American edition (1992). These nonionic surfactants suitable for use herein include alkyl glucosides, alkyl polyglucosides, polyhydroxy fatty acid amides, alkoxylated fatty acid esters, sucrose esters, amine oxides, and combinations thereof.

Zwitterionic surfactants suitable include those that are broadly described as derivatives of aliphatic quaternary ammonium, phosphonium, and sulfonium compounds, in which the aliphatic radicals can be straight or branched chain, and wherein one of the aliphatic substituents contains from about 8 to about 18 carbon atoms and one contains an anionic group, e.g., carboxy, sulfonate, sulfate, phosphate, or phosphonate. Such suitable zwitterionic surfactants can be represented by the formula:

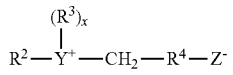

wherein $R^2$ contains an alkyl, alkenyl, or hydroxy alkyl radical of from about 8 to about 18 carbon atoms, from 0 to about 10 ethylene oxide moieties and from 0 to about 1 glyceryl moiety; Y is selected from the group consisting of nitrogen, phosphorus, and sulfur atoms; $R^3$ is an alkyl or monohydroxyalkyl group containing about 1 to about 3 carbon atoms;

X is 1 when Y is a sulfur atom, and 2 when Y is a nitrogen or phosphorus atom; $R^4$ is an alkylene or hydroxyalkylene of from about 1 to about 4 carbon atoms and Z is a radical selected from the group consisting of carboxylate, sulfonate, sulfate, phosphonate, and phosphate groups.

Other zwitterionic surfactants suitable for use herein include betaines, including high alkyl betaines such as coco dimethyl carboxymethyl betaine, cocoamidopropyl betaine, cocobetaine, lauryl amidopropyl betaine, oleyl betaine, lauryl dimethyl carboxymethyl betaine, lauryl dimethyl alphacarboxyethyl betaine, cetyl dimethyl carboxymethyl betaine, lauryl bis-(2-hydroxyethyl) carboxymethyl betaine, stearyl bis-(2-hydroxypropyl) carboxymethyl betaine, oleyl dimethyl gamma-carboxypropyl betaine, and lauryl bis-(2-hydroxypropyl)alpha-carboxyethyl betaine. The sulfobetaines may be represented by coco dimethyl sulfopropyl betaine, stearyl dimethyl sulfopropyl betaine, lauryl dimethyl sulfoethyl betaine, lauryl bis-(2-hydroxyethyl) sulfopropyl betaine and the like; amidobetaines and amidosulfobetaines, wherein the $RCONH(CH_2)_3$ radical, wherein R is a $C_{11}$-$C_{17}$ alkyl, is attached to the nitrogen atom of the betaine are also useful in this invention.

Water-Soluble Polymer ("Polymer Structurant")

The Article comprises water-soluble polymer that functions as a structurant. As used herein, the term "water-soluble polymer" is broad enough to include both water-soluble and water-dispersible polymers, and is defined as a polymer with a solubility in water, measured at 25° C., of at least about 0.1 gram/liter (g/L). In some embodiments, the polymers have solubility in water, measured at 25° C., of from about 0.1 gram/liter (g/L). to about 500 grams/liter (g/L). (This indicates production of a macroscopically isotropic or transparent, colored or colorless solution). The polymers for making these solids may be of synthetic or natural origin and may be modified by means of chemical reactions. They may or may not be film-forming. These polymers should be physiologically acceptable, i.e., they should be compatible with the skin, mucous membranes, the hair and the scalp.

The one or more water-soluble polymers of the present invention are selected such that their weighted average molecular weight is from about 40,000 to about 500,000, in one embodiment from about 50,000 to about 400,000, in yet another embodiment from about 60,000 to about 300,000, and in still another embodiment from about 70,000 to about 200,000. The weighted average molecular weight is computed by summing the average molecular weights of each polymer raw material multiplied by their respective relative weight percentages by weight of the total weight of polymers present within the porous solid.

In one embodiment, at least one of the one or more water-soluble polymers is chosen such that a 2% by weight solution of the water-soluble polymer gives a viscosity at 20° C. of from about 4 centipoise to about 80 centipoise; in an alternate embodiment from about 5 centipoise to about 70 centipoise; and in another embodiment from about 6 centipoise to about 60 centipoise.

The water-soluble polymer may be present from about 10 wt % to about 50 wt % by weight of the Article of one or more water-soluble polymer, in one embodiment from about 15 wt % to about 40 wt %, and in a particular embodiment from about 20 wt % to about 30 wt % by weight of the Article of one or more water-soluble polymer.

The water-soluble polymer(s) of the present invention can include, but are not limited to, synthetic polymers including polyvinyl alcohols, polyvinylpyrrolidones, polyalkylene oxides, e.g. polyethyleneimines including, but not limited to PEI 600, polyacrylates, caprolactams, polymethacrylates, polymethylmethacrylates, polyacrylamides, polymethylacrylamides, polydimethylacrylamides, polyethylene glycol monomethacrylates, polyurethanes, polycarboxylic acids, polyvinyl acetates, polyesters, polyamides, polyamines, polyethyleneimines, maleic/(acrylate or methacrylate) copolymers, copolymers of methylvinyl ether and of maleic anhydride, copolymers of vinyl acetate and crotonic acid, copolymers of vinylpyrrolidone and of vinyl acetate, copolymers of vinylpyrrolidone and of caprolactam, vinyl pyrollidone/vinyl acetate copolymers, copolymers of anionic, cationic and amphoteric monomers, and combinations thereof.

The water-soluble polymer(s) which are suitable may also be selected from naturally sourced polymers including those of plant origin examples of which include karaya gum, tragacanth gum, gum Arabic, acemannan, konjac mannan, acacia gum, gum ghatti, whey protein isolate, and soy protein isolate; seed extracts including guar gum, locust bean gum, quince seed, and psyllium seed; seaweed extracts such as Carrageenan, alginates, and agar; fruit extracts (pectins); those of microbial origin including xanthan gum, gellan gum, pullulan, hyaluronic acid, chondroitin sulfate, and dextran; and those of animal origin including casein, gelatin, keratin, keratin hydrolysates, sulfonic keratins, albumin, collagen, glutelin, glucagons, gluten, zein, and shellac.

Modified natural polymers are also useful as water-soluble polymer(s) in the present invention. Suitable modified natural polymers include, but are not limited to, cellulose derivatives such as hydroxypropylmethylcellulose, hydroxymethylcellulose, hydroxyethylcellulose, methylcellulose, hydroxypropylcellulose, ethylcellulose, carboxymethylcellulose, cellulose acetate phthalate, nitrocellulose and other cellulose ethers/esters; and guar derivatives such as hydroxypropyl guar.

Preferred water-soluble polymers of the present invention include polyvinyl alcohols, polyvinylpyrrolidones, polyalkylene oxides, starch and starch derivatives, pullulan, gelatin, hydroxypropylmethylcelluloses, methycelluloses, and carboxymethycelluloses.

More preferred water-soluble polymers of the present invention include polyvinyl alcohols, and hydroxypropylmethylcelluloses. Suitable polyvinyl alcohols include those available from Celanese Corporation (Dallas, Tex.) under the CELVOL® trade name. Suitable hydroxypropylmethylcelluloses include those available from the Dow Chemical Company (Midland, Mich.) under the METHOCEL® trade name including combinations with above mentioned hydroxypropylmethylcelluloses.

In a particular embodiment, the above mentioned water-soluble polymer(s) may be blended with any single starch or combination of starches as a filler material in such an amount as to reduce the overall level of water-soluble polymers required, so long as it helps provide the Article with the requisite structure and physical/chemical characteristics as described herein.

In such instances, the combined weight percentage of the water-soluble polymer(s) and starch-based material generally ranges from about 10% to about 40 wt %, in one embodiment from about 12 to about 30%, and in a particular embodiment from about 15% to about 25% by weight relative to the total weight of the Article. The weight ratio of the water-soluble polymer(s) to the starch-based material can generally range from about 1:10 to about 10:1, in one embodiment from about 1:8 to about 8:1, in still another embodiment from about 1:7 to about 7:1, and in yet another embodiment from about 6:1 to about 1:6.

Typical sources for starch-based materials can include cereals, tubers, roots, legumes and fruits. Native sources can include corn, pea, potato, banana, barley, wheat, rice, sago, amaranth, tapioca, arrowroot, canna, sorghum, and waxy or high amylase varieties thereof. The starch-based materials may also include native starches that are modified using any modification known in the art, including physically modified starches examples of which include sheared starches or thermally-inhibited starches; chemically modified starches including those which have been cross-linked, acetylated, and organically esterified, hydroxyethylated, and hydroxypropylated, phosphorylated, and inorganically esterified, cationic, anionic, nonionic, amphoteric and zwitterionic, and succinate and substituted succinate derivatives thereof; conversion products derived from any of the starches, including fluidity or thin-boiling starches prepared by oxidation, enzyme conversion, acid hydrolysis, heat or acid dextrinization, thermal and or sheared products may also be useful herein; and pregelatinized starches which are known in the art.

Plasticizer

The Article may comprise a water soluble plasticizing agent suitable for use in compositions discussed herein. Non-limiting examples of suitable plasticizing agents include polyols, copolyols, polycarboxylic acids, polyesters and dimethicone copolyols.

Examples of useful polyols include, but are not limited to, glycerin, diglycerin, propylene glycol, ethylene glycol, butylene glycol, pentylene glycol, cyclohexane dimethanol, hexane diol, polyethylene glycol (200-600), sugar alcohols such as sorbitol, manitol, lactitol and other mono- and polyhydric low molecular weight alcohols (e.g., $C_2$-$C_8$ alcohols); mono di- and oligo-saccharides such as fructose, glucose, sucrose, maltose, lactose, and high fructose corn syrup solids and ascorbic acid.

Examples of polycarboxylic acids include, but are not limited to citric acid, maleic acid, succinic acid, polyacrylic acid, and polymaleic acid.

Examples of suitable polyesters include, but are not limited to, glycerol triacetate, acetylated-monoglyceride, diethyl phthalate, triethyl citrate, tributyl citrate, acetyl triethyl citrate, acetyl tributyl citrate.

Examples of suitable dimethicone copolyols include, but are not limited to, PEG-12 dimethicone, PEG/PPG-18/18 dimethicone, and PPG-12 dimethicone. Other suitable plasticizers include, but are not limited to, alkyl and allyl phthalates; naphthalates; lactates (e.g., sodium, ammonium and potassium salts); sorbeth-30; urea; lactic acid; sodium pyrrolidone carboxylic acid (PCA); sodium hyaluronate or hyaluronic acid; soluble collagen; modified protein; monosodium L-glutamate; alpha & beta hydroxyl acids such as glycolic acid, lactic acid, citric acid, maleic acid and salicylic acid; glyceryl polymethacrylate; polymeric plasticizers such as polyquaterniums; proteins and amino acids such as glutamic acid, aspartic acid, and lysine; hydrogen starch hydrolysates; other low molecular weight esters (e.g., esters of $C_2$-$C_{10}$ alcohols and acids); and any other water soluble plasticizer known to one skilled in the art of the foods and plastics industries; and mixtures thereof.

Preferred plasticizers include glycerin and propylene glycol. EP 0283165 B1 discloses other suitable plasticizers, including glycerol derivatives such as propoxylated glycerol.

The plasticizer, may be present from 0 wt % to about 15 wt %, by weight of the Article of a plasticizer, alternatively from about 1 wt % to about 15 wt %, in one embodiment from about 3 wt % to about 12 wt %, and in another embodiment from about 5 w.

Bleach and Laundry additives according to the present invention may comprise may comprise: film-forming water-soluble polymer; water; surfactant; chelant; plasticizer; hueing agent; bleach; bleach stabilizer; suds suppressor and optional compositions including, but not limited to enzyme.

Optional Ingredients

The Article may further comprise other optional ingredients that are known for use or otherwise useful in fabric and home care compositions, provided that such optional materials are compatible with the selected essential materials described herein, i.e., the optional materials do not unduly impair product performance.

Such optional ingredients are most typically those materials approved for use in cosmetics and that are described in reference books such as the CTFA Cosmetic Ingredient Handbook, Second Edition, The Cosmetic, Toiletries, and Fragrance Association, Inc. 1988, 1992. Non limiting examples of such optional ingredients include preservatives, perfumes or fragrances, coloring agents or dyes, conditioning agents, hair bleaching agents, thickeners, moisturizers, emollients, pharmaceutical actives, vitamins or nutrients, sunscreens, deodorants, sensates, plant extracts, nutrients, astringents, cosmetic particles, absorbent particles, adhesive particles, hair fixatives, fibers, reactive agents, skin lightening agents, skin tanning agents, anti-dandruff agents, perfumes, exfoliating agents, acids, bases, humectants, enzymes, suspending agents, pH modifiers, hair colorants, hair perming agents, pigment particles, anti-acne agents, anti-microbial agents, vitamins, sunscreens, tanning agents, exfoliation particles, hair growth or restorer agents, insect repellents, having lotion agents, co-solvents or other additional solvents, and similar other materials.

Other preferred optional ingredients include organic solvents, especially water miscible solvents and co-solvents useful as solubilizing agents for polymeric structurants and as drying accelerators. Non-limiting examples of suitable solvents include alcohols, esters, ketones, aromatic hydrocarbons, aliphatic hydrocarbons, ethers, and combinations thereof. Alcohols and esters are more preferred. Preferred alcohols are monohydric. The most preferred monohydric alcohols are ethanol, iso-propanol, and n-propanol. The most preferred esters are ethyl acetate and butyl acetate. Other non-limiting examples of suitable organic solvents are benzyl alcohol, amyl acetate, propyl acetate, acetone, heptane, isobutyl acetate, iso-propyl acetate, toluene, methyl acetate, isobutanol, n-amyl alcohol, n-butyl alcohol, hexane, and methyl ethyl ketone. methanol, ethanol, n-propanol, isopropanol, n-butanol, isobutanol, methylethylketone, acetone, and combinations thereof.

Other preferred optional ingredients include latex or emulsion polymers, thickeners such as water soluble polymers, clays, silicas, ethylene glycol distearate, deposition aids, including coacervate forming components and quaternary amine compounds.

Product Form

The Article can be produced in any of a variety of product forms, including dissolvable porous solids used alone or in combination with other fabric and home care components. The dissolvable porous solids can be used in a continuous or discontinuous manner when used within fabric and home care compositions. Regardless of the product form, the key to all of the product form embodiments contemplated within the scope of the method of the present invention is the selected and defined Article that comprises a combination of a solid polymeric structurant and a surfactant-containing active ingredient, all as defined herein.

The Article is preferably in the form of one or more flat sheets or pads of an adequate size to be able to be handled easily by the user. It may have a square, rectangle or disc shape or any other suitable shape. The pads can also be in the form of a continuous strip including delivered on a tape-like roll dispenser with individual portions dispensed via perforations and or a cutting mechanism. Alternatively, the Articles are in the form of one or more cylindrical objects, spherical objects, tubular objects or any other shaped object.

The Article may comprise one or more textured, dimpled or otherwise topographically patterned surfaces including letters, logos or figures. The textured substrate preferably results from the shape of the substrate, in that the outermost surface of the substrate contains portions that are raised with respect to other areas of the surface. The raised portions can result from the formed shape of the article, for example the article can be formed originally in a dimpled or waffle pattern. The raised portions can also be the result of creping processes, imprinted coatings, embossing patterns, laminating to other layers having raised portions, or the result of the physical form of the dissolvable porous solid substrate itself. The texturing can also be the result of laminating the substrate to a second substrate that is textured.

In a particular embodiment, the Article can be perforated with holes or channels penetrating into or through the porous solid. These perforations can be formed during the drying process via spikes extended from the surface of the underlying mold, belt or other non-stick surface. Alternatively, these perforations can be formed after the drying process via poking or sticking the porous solids with pins, needles or other sharp objects. Preferably, these perforations are great in number per surface area, but not so great in number so as to sacrifice the integrity or physical appearance of the porous solid. It has been found that such perforations increase the dissolution rate of the porous solids into water relative to un-perforated porous solids.

The Article can also be delivered via a water insoluble implement or device. For instance, they may be attached or glued by some mechanism to an applicator to facilitate application to hair and/or skin, i.e., a comb, rag, wand, or any other conceivable water-insoluble applicator. Additionally, the Article may be adsorbed to the surfaces a separate high surface area water-insoluble implement, i.e., a porous sponge, a puff, a flat sheet etc. For the latter, the dissolvable porous solid of the present invention may be adsorbed as a thin film or layer.

Product Types

Non-limiting examples of product type embodiments for use by the Article and methods of the present invention include hand cleansing substrates, hair shampoo or other hair treatment substrates, body cleansing substrates, shaving preparation substrates, pet care substrates, fabric and home care substrates containing pharmaceutical or other skin care active, moisturizing substrates, sunscreen substrates, chronic skin benefit agent substrates (e.g., vitamin-containing substrates, alpha-hydroxy acid-containing substrates, etc.), deodorizing substrates, fragrance-containing substrates, and so forth.

II. METHOD OF MANUFACTURE

The Article can be prepared by the process comprising: (1) Preparing a processing PREMIX comprising surfactant(s), plasticizer and other optional ingredients; (2) Adding polymer or structurant solution to just prior to aeration (3) Aerating the mixture by introducing a gas into the mixture forming the WET SPONGE; (4) Forming the aerated wet mixture into a desired one or more shapes; and (5) Drying the aerated wet mixture to a desired final moisture content forming the DRY SPONGE (e.g., from about 5% to about 75% moisture or Remaining Water in the PREMIX and WET SPONGE to about 1% moisture in the DRY SPONGE by addition of energy). The polymer is added to the premix just before aeration particularly if there is any gap in time between mixing and aeration.

I. Premix

Surfactants, total water (free and bound), neutralizers/pH adjustors, plasticizer(s), rheology modifier(s), polymer(s)/structurant(s), aesthetics agent (e.g., whiteners), chelants Premix may or may not contain solvents, enzymes, dyes and/or perfumes Just before aeration add water soluble polymer (e.g., PVA) and/or structurant solution 15-75% Surfactants 10-65% total water=bound plus free water 5-15% Neutralizers/pH adjusting agents 1-10% Plasticizers 1-10% Rheology modifiers 1-10% Polymer(s) and/or Structurant(s)

1-10% Aesthetics actives (e.g., whiteners)

1-10% Chelants (lend stability to surfactant and overall premix system)

II. Wet sponge/OCF=premix plus PVA 10-55% Surfactants 30-75% total water=bound plus free water 1-15% Neutralizers/pH adjusting agents 0.1-10% Plasticizers 0.1-10% Rheology modifiers 1-30% Polymer(s) and/or Structurant(s) 0.1-10% Aesthetics actives (e.g., whiteners) 0.1-10% Chelants (lend stability to surfactant and overall premix system)

III. Dry sponge=wet sponge with water evaporated off via heat application 10-65% Surfactant 0.1-5% total water=bound plus free water 1-15% Neutralizers/pH adjusting agents 0.1-10% Plasticizers 0.1-10% Rheology modifiers 1-60% Polymer(s) and/or Structurant(s) 0.1-10% Aesthetics actives (e.g., whiteners) 0.1-10%

Chelants (lend stability to surfactant and overall premix system)

Processing of the Open Cell Foam (Wet Sponge and Dry Sponge) Formulations

1. Store the Premix and the PVOH/Sponge Initiating Solution separately.

2. Confirm that the aluminum and the teflon molds are clean, labeled, and weights are recorded.

3. Just before processing, fill the water jacket to the fill line with 70° C. tap water and secure on KitchenAid Pro 500 mixer.

4. Record the grams of Premix transferred to the KitchenAid Pro 500 mixing bowl.

5. Record the grams of PVOH/Sponge Initiating Solution transferred to the KitchenAid Pro 500 mixing bowl.

6. Attached Flat Beater, anchor Mixing Bowl, and lift Water Jacket filled with 70 C water to immerse bottom of Mixing Bowl and the contents in the heated water jacket bath.

7. Turn on agitation to mix and aerate the Premix and the PVOH/Sponge Initiating Solution via the Flat Beater at the KitchenAid Pro 500 mixer speed setting of "10" for three (3:00) minutes. (The speed of "10" is equivalent to approximately 225 to 231 RPMs per the manufacturer.)

8. Stop the mixer after ~1 minute of aeration, for no more than 10 seconds, and use a large rubber spatula to insure that the contents at the very bottom and along the sides of the bowl are mixing into the bulk to form a homogeneous Wet Sponge product.

9. Start timer to resume aeration for the remaining ~2 minutes.

10. At the end of the 3 minute aeration process, remove mixing bowl and contents from the water jacket, i.e., remove from the heat source. Specifically, immediately after a total of 3 minutes for aeration—after completion of the physical aeration/mixing phase Remove and place on a non-heated surface.

11. Immediately transfer the wet/open cell foam formulation out of the mixing bowl into the aluminum molds, level, weigh and record the resulting weight, place in 135° C. oven for fifty (50) minutes. Record time for placement in the drying oven. Record time for removal out of the oven to confirm/document bake time (e.g., 50 minutes).

12. Transfer a portion of the wet/open cell foam formulation out of the mixing bowl into a circle-shaped Teflon mold with a known volume. Fill, level off with a spatula, and record the filled weight. The differences are used to estimate wet/open cell foam density.

13. After 50 minutes of drying at 135° C., remove aluminum molds from oven and allow to cool to room temp.

14. Record weight of mold and the resulting dry/open cell foam. Use weight differences to account for water loss and for solids content.

15. Peel resulting dry/open cell foam out of mold. Use caliper to measure thickness and to determine the density of the resulting dry/open cell foam.

16. Finished product differentiation to include, but not limited to, applying, for example, Zeolite (sodium alumino silicate) to reduce tacky feel, spraying drying on enzymes, spraying drying on perfume, perfume microcapsules, etc., that in themselves may alter the wet/open cell foam and/or may be altered if added during wet/ to dry/open cell foam processing.

Preparation of Processing Mixture

The processing mixture is generally prepared by dissolving the polymer structurant in the presence of water, plasticizer and other optional ingredients by heating followed by cooling. This can be accomplished by any suitable heated batch agitation system or via any suitable continuous system involving either single screw or twin screw extrusion or heat exchangers together with either high shear or static mixing. Any process can be envisioned such that the polymer is ultimately dissolved in the presence of water, the surfactant(s), the plasticizer, and other optional ingredients including stepwise processing via pre-mix portions of any combination of ingredients.

The processing mixtures of the present invention comprise: from about 15% to about 40% solids, in one embodiment from about 20% to about 35% solids, and in another embodiment from about 25% to about 30% solids, by weight of the processing mixture before drying; and have a viscosity of from about 2,500 cps to about 30,000 cps, in one embodiment from about 5,000 cps to about 25,000 cps, in another embodiment from about 7,500 cps to about 20,000 cps, and in still another embodiment from about 10,000 cps to about 15,000 cps.

The % solids content is the summation of the weight percentages by weight of the total processing mixture of all of the solid, semi-solid and liquid components excluding water and any obviously volatile materials such as low boiling alcohols. The processing mixture viscosity values are measured using a TA Instruments AR500Rheometer with 4.0 cm diameter parallel plate and 1,200 micron gap at a shear rate of 1.0 reciprocal seconds for a period of 30 seconds at 23° C.

Aeration of Processing Mixture

The aeration of the processing mixture is accomplished by introducing a gas into the mixture, preferably by mechanical mixing energy but also may be achieved via chemical means. The aeration may be accomplished by any suitable mechanical processing means, including but not limited to: (i) Batch tank aeration via mechanical mixing including planetary mixers or other suitable mixing vessels, (ii) semi-continuous or continuous aerators utilized in the food industry (pressurized and non-pressurized), or (iii) spray-drying the processing mixture in order to form aerated beads or particles that can be compressed such as in a mould with heat in order to form the porous solid.

In a particular embodiment, it has been discovered that the Article can be prepared within continuous pressurized aerators that are conventionally utilized within the foods industry in the production of marshmallows. Suitable continuous pressurized aerators include the Morton whisk (Morton Machine Co., Motherwell, Scotland), the Oakes continuous automatic mixer (E.T. Oakes Corporation, Hauppauge, N.Y.), the Fedco Continuous Mixer (The Peerless Group, Sidney, Ohio), and the Preswhip (Hosokawa Micron Group, Osaka, Japan).

Forming the Aerated Wet Processing Mixture

The forming of the aerated wet processing mixture may be accomplished by any suitable means to form the mixture in a desired shape or shapes including, but not limited to (i) depositing the aerated mixture to moulds of the desired shape and size comprising a non-interacting and non-stick surface including aluminium, Teflon, metal, HDPE, polycarbonate, neoprene, rubber, LDPE, glass and the like; (ii) depositing the aerated mixture into cavities imprinted in dry granular starch contained in a shallow tray, otherwise known as starch moulding forming technique; and (iii) depositing the aerated mixture onto a continuous belt or screen comprising any non-interacting or non-stick material Teflon, metal, HDPE, polycarbonate, neoprene, rubber, LDPE, glass and the like which may be later stamped, cut, embossed or stored on a roll.

Drying the Formed Aerated Wet Processing Mixture

The drying of the formed aerated wet processing mixture may be accomplished by any suitable means including, but not limited to (i) drying room(s) including rooms with controlled temperature and pressure or atmospheric conditions; (ii) ovens including non-convection or convection ovens with controlled temperature and optionally humidity; (iii) Truck/Tray driers, (iv) multi-stage inline driers; (v) impingement ovens; (vi) rotary ovens/driers; (vii) inline roasters; (viii) rapid high heat transfer ovens and driers; (ix) dual plenum roasters, and (x) conveyor driers.

Optional ingredients may be imparted during any of the above described four processing steps or even after the drying process.

The Article may also be prepared with chemical foaming agents by in-situ gas formation (via chemical reaction of one or more ingredients, including formation of $CO_2$ by an effervescent system).

III. PHYSICAL CHARACTERISTICS

Dissolution Rate

The Article has a Dissolution Rate that allows the porous solid to rapidly disintegrate during use application with water. The Dissolution Rate of the Article is determined in accordance with the two methodologies described below.

Conductivity Dissolution Method: In a 250 ml beaker, 150+/−0.5 grams of distilled water is weighed at room temperature. The beaker is placed on an orbital shaker, for example a VWR model DS-500E and started at 150 RPM. A conductivity probe, for example a VWR model 2052 connected to a VWR conductivity meter, is submerged just below the surface of the water in such a manner that the conductivity probe remains stationary in relation to the motion of the beaker and never touches the side of the beaker. A 0.20+/−0.01 grams of the dissolvable porous solid is weighed and placed into the water. Conductivity data is recorded every 15 seconds for 6 minutes, and then once a minute until 30 minutes. The final value is recorded when the conductivity values stopped changing or 30 minutes is reached, whichever is earlier. The conductivity dissolution time is taken as the time it takes in seconds until the conductivity values stop changing or as the maximum of 30 minutes, which ever happens first.

Alternate Dissolution Method—Beaker Dissolution Method: A known amount of the dissolvable porous solid is placed in a 600 ml beaker (VWR/Catalog #89000-20008) with an octagonal stir bar (VWR/Catalog #58948-150). Room temperature (20° C.-25° C.) deionized water is weighed out such that when combined with the dissolvable porous sold the resulting ratio is 1 part solid to 49 parts DI water, respectively. Upon addition of the DI water (temperature noted and recorded) to the beaker, the stirrer (set at 300 RPMs) and the timer are started simultaneously. When the dissolvable porous solid is completely dissolve, the timer is stopped and the time is noted and recorded.

The Article has a beaker dissolution value of from about less than 30 seconds to about 10 minutes, in one embodiment from about 50 seconds, in another embodiment from 20 seconds, in another embodiment greater than 2 minutes, in another embodiment about 20 seconds, in another embodiment about 37 seconds, in another embodiment about 15 seconds, in another embodiment about 17 seconds, and in still another embodiment from about 25 seconds.

Distance to Maximum Force Method

The distance to maximum force is measured via a Rupture Method on a Texture Analyzer using a TA-57R cylindrical probe with Texture Exponent 32 Software. The Article should have a thickness of between 4 to 7 mm and cut in a circle with a diameter of at least 7 mm for this method; or carefully cut or stacked to be within this overall thickness and diameter range. The porous solid sample is carefully mounted on top of the cylinder with four screws mounted on top with the top lid affixed in place on top of the sample. There is a hole in the center of the cylinder and its lid which allows the probe to pass through and stretch the sample. The sample is measured with a pre-test speed of 1 mm per second, a test speed of 2 mm per second and a post test speed of 3 mm per second over a total distance of 30 mm. The distance to maximum force is recorded.

Sponges—Physical Data for Representative Open Celled Foam Sponges

| Representative Sponge | Star Volume | SMI | Wall Thickness (Strut Thickness) | Kr BET Specific Surface Area, $m^2/g$ | Viscosity ~1,000 cps to 30,000 cps (wet sponge) | Tensile Strength | % Elongation (Tensile strain at Maximum Load) | Dissolution |
|---|---|---|---|---|---|---|---|---|
| HDL | ≧8.1 | ≧2.4 | ≧.9 mm | 0.0250-0.0354 $m^2/g$ | 21,637 cps | ≧0.05 $N/mm^2$ | ≧46% | ≧20 seconds |

IV. METHODS OF USE

The compositions of the present invention may be used for cleaning and otherwise treating fabrics, garments, textiles and articles used or worn by the consumer while providing, rapid sudsing and/or rinse-ability. The method for cleaning and conditioning garments may comprise the steps of: a) wetting the dissolvable porous solid with water, (b) applying the wetted solid to the garment surface to clean or remove the stain and/or, (c) applying an effective amount of the dissolvable porous solid to the substrate (garment), d) the dissolved material to either the garment such as to treat or cleanse, and d) rinsing the diluted treatment or cleaning composition from the garment/article using water. These steps can be repeated as many times as desired to achieve the desired cleaning and or treatment benefit.

V. ARTICLE OF COMMERCE

The present invention provides for an article of commerce comprising one or more compositions described herein, and a communication directing a consumer to dissolve the porous solid in water and use as directed and/or as intended. The communication may be printed material attached directly or indirectly to packaging that contains the composition or on the composition itself. Alternatively, the communication may be an electronic or a broadcast message that is associated with the article of manufacture. Alternatively, the communication may describe at least one possible use, capability, distinguishing feature and/or property of the article of manufacture.

VI. EXAMPLES

The following examples further describe and demonstrate embodiments within the scope of the present invention. The examples are given solely for the purpose of illustration and are not to be construed as limitations of the present invention, as many variations thereof are possible without departing from the spirit and scope of the invention. All exemplified amounts are concentrations by weight of the total composition, i.e., wt/wt percentages, unless otherwise specified.

Example 1

Dissolving Porous Detergent Open Celled Foam Sponge Made with Polyvinyl Alcohol The following dissolving porous solid is prepared in accordance to the present invention. Table 1 represents the 0% to 33.3% Polymer (e.g., PVA) and/or Structurant Solution which is added to the Premix prior to aeration in each example for the formation of the Wet Sponge followed by formation of the Dry Sponge:

PreMix

TABLE 1

| Component | Wt % |
|---|---|
| Distilled water (Free water; Hole) | 67.000 |
| Polyvinyl alcohol and/or Structurant[1] (Hole) | 33.000 |
| Total | 100.0 |

[1]Option #1: PVA = Poly(vinyl alcohol), 87-89% hydrolyzed, MW = 85-124 × 1000, Aldrich, Catalog # 363081, St. Louis, MO.
[1]Option #2: PVA = Poly(vinyl alcohol), 87-89% hydrolyzed, MW = 83-90 × 1000, DuPont, Elvanol/Grade 52-22, Wilmington, DE
[1]Option #3: PVA = Poly(vinyl alcohol), 100% hydrolyzed, MW = , DuPont, Elvanol/Grade 80-18, Wilmington, DE.
[1]Option #4: CELVOL ® 523 available from Celanese Corporation (Dallas, Texas).

TABLE 2

| Component | Wt % |
|---|---|
| Distilled water | QS 100 |
| Glycerin | 3.1 |
| $C_{12/15}AE_{1.8}S$[2] | 28.4 |
| $C_{11.8}HLAS$[3] | 12.2 |
| HSAS[4] | 4.5 |
| $C_{12/14}EO_9$[5] | 1.2 |
| $C_{12/14}$ Amine Oxide[6] | 1.5 |
| Monoethanolamine | 7.1 |
| PE20[7] | 3.0 |
| $PEI_{600}EO_{24}PO_{16}$[8] | 3.0 |
| DTPA | 1.1 |
| Tiron[9] | 1.1 |
| Brightener 15 | 2.1 |

[2]$C_{12/15}$ alkyl ethoxylate$_{1.8}$ sulfate
[3]$C_{11.8}$ alkylbenzesulfonate
[4]$C_{16/17}$ mid-chain branched alkyl sulfate
[5]$C_{12/14}$ alkyl ethoxylate$_9$
[6]C12/14 alkyl amine oxide
[7]Polyethylglycol$_{20}$
[8]Polyethyleneimine (600 MW) ethoxylate$_{24}$ propoxylate$_{16}$
[9]Catechol disulfate Wet Sponge

TABLE 3

| Component | Wt % |
|---|---|
| Distilled water | QS 100 |
| Polyvinylalcohol[1] | 15.0 |
| Glycerin | 1.8 |
| $C_{12/15}AE_{1.8}S$[2] | 11.4 |
| $C_{11.8}HLAS$[3] | 4.9 |
| HSAS[4] | 4.5 |
| $C_{12/14}EO_9$[5] | 0.5 |
| $C_{12/14}$ Amine Oxide[6] | 0.6 |
| Monoethanolamine | 2.8 |
| PE20[7] | 1.2 |
| $PEI_{600}EO_{24}PO_{16}$[8] | 1.2 |
| DTPA | 0.4 |

TABLE 3-continued

| Component | Wt % |
|---|---|
| Tiron[9] | 0.4 |
| Brightener 15 | 0.9 |

[1]Option #1: PVA = Poly(vinyl alcohol), 87-89% hydrolyzed, MW = 85-124 × 1000, Aldrich, Catalog # 363081, St. Louis, MO.
[1]Option #2: PVA = Poly(vinyl alcohol), 87-89% hydrolyzed, MW = 83-90 × 1000, DuPont, Elvanol/Grade 52-22, Wilmington, DE
[1]Option #3: PVA = Poly(vinyl alcohol), 100% hydrolyzed, MW = , DuPont, Elvanol/Grade 80-18, Wilmington, DE.
[1]Option #4: CELVOL ® 523 available from Celanese Corporation (Dallas, Texas).
[2]$C_{12/15}$ alkyl ethoxylate$_{1.8}$ sulfate
[3]$C_{11.8}$ alkylbenzesulfonate
[4]$C_{16/17}$ mid-chain branched alkyl sulfate
[5]$C_{12/14}$ alkyl ethoxylate$_9$
[6]C12/14 alkyl amine oxide
[7]Polyethylglycol$_{20}$
[8]Polyethyleneimine (600 MW) ethoxylate$_{24}$ propoxylate$_{16}$
[9]Catechol disulfate "Dry" Sponge

TABLE 4

| Component | Wt % |
|---|---|
| Distilled water | QS 100 |
| Polyvinylalcohol[1] | 35.1 |
| Glycerin | 1.8 |
| $C_{12/15}AE_{1.8}S$[2] | 26.6 |
| $C_{11.8}HLAS$[3] | 11.4 |
| HSAS[4] | 4.2 |
| $C_{12/14}EO_9$[5] | 0.5 |
| $C_{12/14}$ Amine Oxide[6] | 0.6 |
| Monoethanolamine | 6.7 |
| PE20[7] | 2.8 |
| $PEI_{600}EO_{24}PO_{16}$[8] | 2.8 |
| DTPA | 1.0 |
| Tiron[9] | 1.0 |
| Brightener 15 | 2.1 |

[1]Option #1: PVA = Poly(vinyl alcohol), 87-89% hydrolyzed, MW = 85-124 × 1000, Aldrich, Catalog # 363081, St. Louis, MO.
[1]Option #2: PVA = Poly(vinyl alcohol), 87-89% hydrolyzed, MW = 83-90 × 1000, DuPont, Elvanol/Grade 52-22, Wilmington, DE
[1]Option #3: PVA = Poly(vinyl alcohol), 100% hydrolyzed, MW = , DuPont, Elvanol/Grade 80-18, Wilmington, DE.
[1]Option #4: CELVOL ® 523 available from Celanese Corporation (Dallas, Texas).
[2]$C_{12/15}$ alkyl ethoxylate$_{1.8}$ sulfate
[3]$C_{11.8}$ alkylbenzesulfonate salt
[4]$C_{16/17}$ mid-chain branched alkyl sulfate
[5]$C_{12/14}$ alkyl ethoxylate$_9$
[6]C12/14 alkyl amine oxide
[7]Polyethylglycol$_{20}$
[8]Polyethyleneimine (600 MW) ethoxylate$_{24}$ propoxylate$_{16}$
[9]Catechol disulfate

Example 2

Dissolving Porous Cleanser Solid Laundry Additive with Oxygen Bleach

The dried solid article is used treated with a source of $H_2O_2$ at an equal ratio to HLAS in the formulation and a bleach catalyst.

DISCUSSION OF EXAMPLES

As can be seen in the tabulated figures for Examples 1 the porous open celled foam sponge has a Star Volume of 8.1.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

All documents cited herein are incorporated herein by reference in their entirety; the citation of any document is not to be construed as an admission that it is prior art with respect to the present invention. To the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A laundry additive article consisting of by dry weight percentage:

a. from about 0.05% to about 10% surfactant;

b. from about 1% to about 50% water-soluble and/or water-dispersible film-forming polymer;

c. from about 0% to about 10% plasticizer;

d. from about 0.01% to about 50% chelant; from 0% to about 5% bleach;

e. from about 0% to about 2% bleach stabilizer; from about 0.01% to about 1% suds suppressor;

f. from about 0.1% to about 75% Remaining Water;

such that the article is in the form of a first flexible porous dissolvable solid structure having a dry density and having a Percent open cell content of from about 5% to about 99.9% and a percent elongation at maximum strain of at least 20%; and optionally:

g. from 1% to 15% pH adjusting agent;

h. from 0.1% to 10% rheology modifier; and i. from 0.1% to 10% whitener.

2. A laundry detergent article consisting of by dry weight percentage:

a. from about 15% to about 80% anionic surfactant having a Krafft temperature of from about 20 to about 75;

b. from about 5% to about 60% film-forming water-soluble polymer;

c. from 0% to about 10% plasticizer;

d. from about 0.025% to about 1% enzyme;

e. from about 0.1% to about 75% Remaining Water;

such that the article is in the form of a first flexible porous dissolvable solid structure having a dry density and having a Percent open cell content of from about 5% to about 99.9% and a percent elongation at maximum strain of at least 20%; and optionally:

f. from 1°/0 to 15% pH adjusting agent;

g. from 0.1% to 10% rheology modifier; and h. from 0.1% to 10% whitener.

* * * * *